US005577700A

United States Patent [19]

Williams, Jr.

[11] Patent Number: 5,577,700

[45] Date of Patent: Nov. 26, 1996

[54] CURTAIN ROD MOUNTING DEVICE FOR PREVENTING WINDOW MOLDING DAMAGE

[75] Inventor: Royall E. Williams, Jr., Chapel Hill, N.C.

[73] Assignee: Barry B. Blanchette, Carrboro, N.C.

[21] Appl. No.: 360,640

[22] Filed: Dec. 21, 1994

[51] Int. Cl.[6] ..... A47H 1/10

[52] U.S. Cl. ..... 248/261; 248/220.1; 248/227.2

[58] Field of Search ..... 248/261, 262, 248/265, 267, 231.91, 227.1, 227.2, 220.1, 217.3; 211/105.1; 52/37

[56] References Cited

U.S. PATENT DOCUMENTS

| | | | |
|---|---|---|---|
| 2,783,014 | 2/1957 | Kenney | 248/265 X |
| 2,896,900 | 7/1959 | Fiedler | 248/262 |
| 3,049,327 | 8/1962 | Caudell | 248/265 X |
| 4,283,034 | 8/1981 | Sheehan | 248/909 X |
| 4,889,305 | 12/1989 | Mahan | 248/265 |
| 5,193,775 | 3/1993 | Wagnon | 248/262 |

*Primary Examiner*—Korie Chan

*Attorney, Agent, or Firm*—Richard E. Jenkins, P.A.

[57] ABSTRACT

A curtain rod mounting device for preventing window molding damage comprising a mounting housing with a front mounting surface, and a top surface and a side surface which depend rearwardly from the front mounting surface so that the three surfaces are in generally orthogonal relationship. The top surface of the mounting housing includes a wall securement flange adjacent to and extending upwardly from at least a portion of the rear edge which defines one or more apertures therein for receiving one or more wall securement elements. One embodiment of the mounting device provides for one or more apertures in the front mounting surface for securing a curtain rod bracket thereto and another embodiment provides a curtain rod bracket as an integral part of the front mounting surface.

16 Claims, 3 Drawing Sheets

CURTAIN ROD MOUNTING DEVICE FOR PREVENTING WINDOW MOLDING DAMAGE

TECHNICAL FIELD

The present invention relates to devices for mounting curtain rods to window moldings, and more particularly to an improved device for mounting curtain rods to window moldings without damage to the window moldings.

RELATED ART

As is well known to all homeowners, mounting curtains on windows can be an arduous and time consuming procedure. The conventional method for mounting curtains to a window frame is to screw or nail a curtain rod bracket onto the front surface of the window frame molding at each of the two top corners. Then, the curtain rod is routinely removably secured at each end thereof to the pair of curtain rod mounting brackets which have been secured to the top corners of the window frame molding.

All too often, however, the securement of curtain rod brackets onto the face of a window frame molding by means of screws or nails results in cracks or striations to the underlying window molding. Although the cracks may be obscured once the curtain rod and curtains are secured to the curtain rod brackets, most homeowners find that cracks and striations weaken the load capacity of the curtain rod bracket and that the damaged window frame molding is distressing. Moreover, the cracks and striations are a more obvious problem requiring filling and painting if the homeowner desires either (1) to remove the curtains and curtain rod brackets during redecorating and leave a curtainless window appearance or (2) to remove and relocate the curtain rod brackets and curtains.

Applicant believes that there have been a number of prior art efforts at developing a curtain rod bracket which does not damage window frame molding. For example, curtain rod brackets have been developed which are adapted to be secured outwardly of the window frame molding into the sheetrock wallboard surrounding the window molding. This type of curtain rod bracket prevents damage to the window frame molding, but requires that the curtain rod extend or traverse a greater distance than the actual width of the window and therefore the appearance of the curtains is somewhat awkward since they are not co-extensive with the width of the window.

Thus, in view of the shortcomings of all efforts known to applicant to successfully address the problem of window frame molding damage suffered during mounting of curtain rod brackets, applicant has now met a long-felt need for a simple and inexpensive curtain rod mounting device that obviates window molding damage without affecting the location or arrangement of the curtains over the window.

DISCLOSURE OF THE INVENTION

In accordance with the present invention, applicant provides a device for mounting a curtain rod to a window without damaging the window molding comprising a mounting housing having a front mounting surface with a top surface and side surface depending rearwardly from two adjacent edges thereof. The front mounting surface and the top and side surfaces of the front mounting surface are in generally orthogonal relationship. Moreover, the top surface which depends rearwardly from the front mounting surface includes a wall securement flange extending upwardly from at least a portion of the rear edge thereof which is spaced-apart and generally parallel to the front mounting surface and includes at least one aperture therein for receiving a nail, a screw or the like therein. Also, the front mounting surface includes means for removably securing one end of a curtain rod thereto.

In one embodiment of applicant's invention, the means for removably securing one end of a curtain rod to the front mounting surface of the mounting housing comprises two spaced-apart apertures to which a conventional curtain rod bracket is secured by means of two screws and two corresponding internally threaded nuts.

An alternative embodiment of the means for removably securing one end of a curtain rod to the front mounting surface of the mounting housing comprises a conventional curtain rod bracket formed as an integral part of the front mounting surface.

It is therefore the object of the present invention to provide a simple and inexpensive curtain rod mounting device for preventing window molding damage such as is incurred with a conventional curtain rod mounting bracket.

It is still another object of the present invention to provide a curtain rod mounting device which is simple to install and allows for a curtain rod to be positioned in the same location as if a conventional curtain rod bracket were utilized.

It is another object of the present invention to provide a curtain rod mounting device which when removed will not leave holes and associated cracks and striations in the window molding.

Some of the objects of the invention having been stated, other objects will become evident as the description proceeds, when taken in connection with the accompanying drawings described hereinbelow.

BEST MODE FOR CARRYING OUT THE INVENTION

Figure 1:
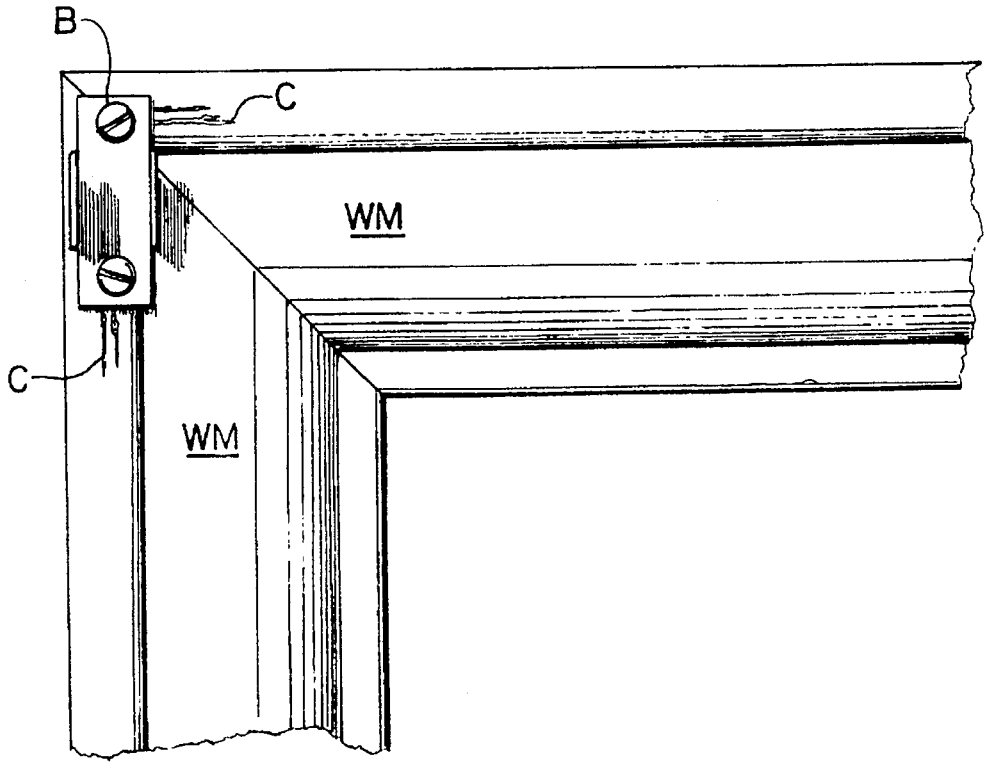
FIG. 1 (PRIOR ART)
FIG. 1 shows a conventional prior art curtain rod bracket mounted on the molding at the corner of a window.
Figure 2:
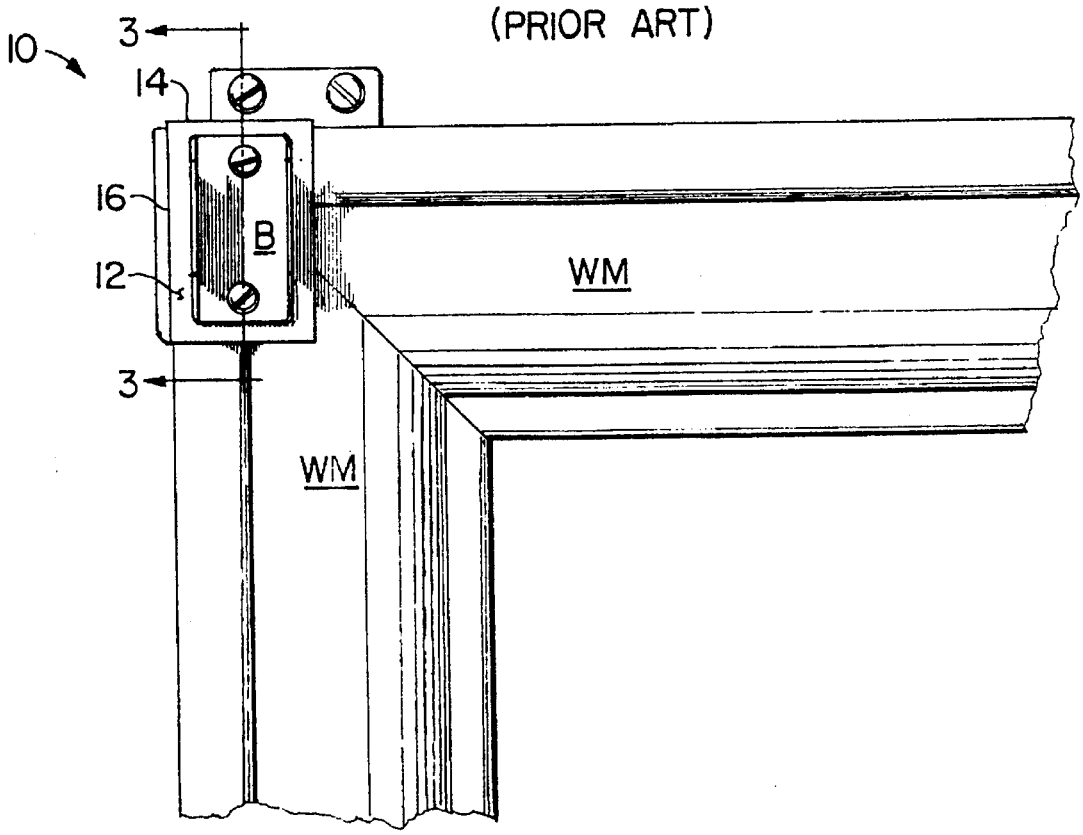
FIG. 2 shows the curtain rod mounting device of the invention mounted in the same location as the prior art curtain rod bracket shown in FIG. 1.
Figure 3:
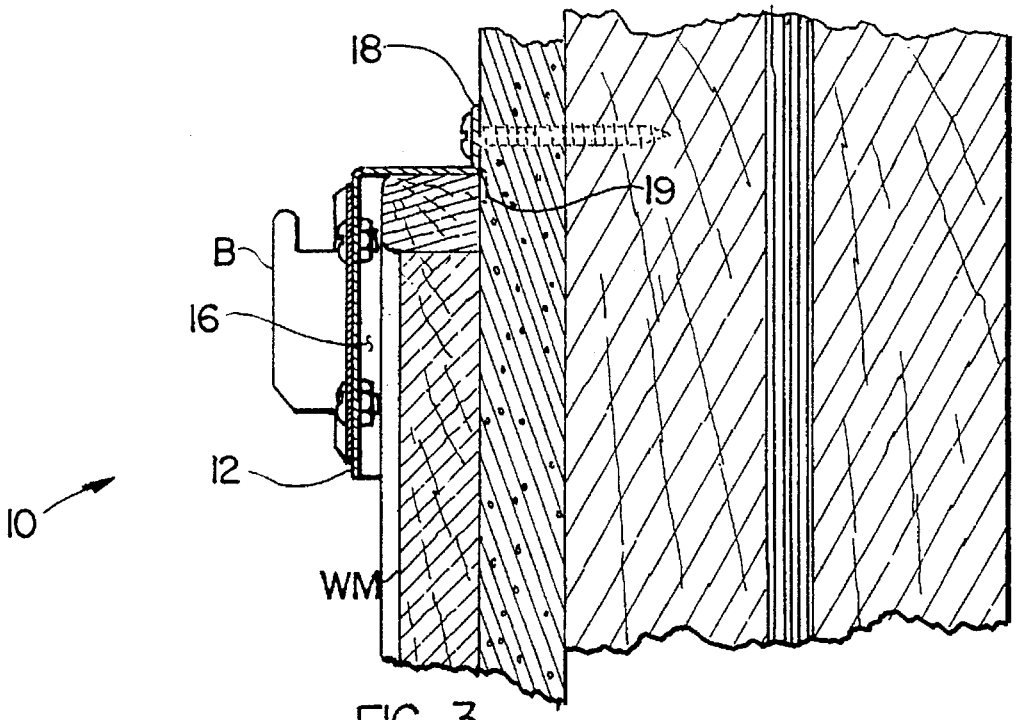
FIG. 3 is a view taken along lines 3—3 of FIG. 2.
Figure 4:
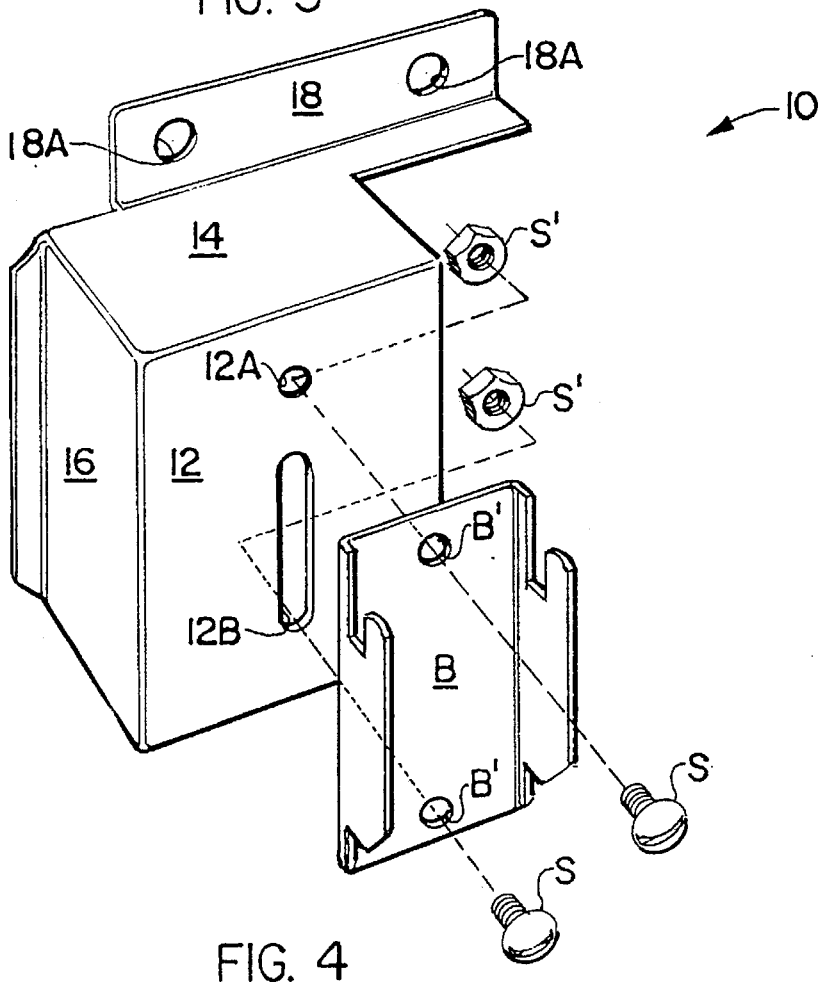
FIG. 4 is an exploded front perspective view showing the curtain rod mounting device of the invention and a curtain rod bracket which will be secured thereto.

Referring now more specifically to the drawings, FIG. 1 shows a conventional curtain rod bracket mounted on the upper left corner of a window molding WM. As can be appreciated from FIG. 1, curtain rod bracket B is conventionally secured to window molding WM by two screws which tend to create cracks or striations C in window molding WM. This, of course, is highly undesirable since it weakens the mount, and is unsightly and poses a repair problem if curtain rod bracket B is ever removed and either (1) repositioned in a different location on the corner of window molding WM or (2) disposed of altogether in order to have a curtainless window. Thus, one can appreciate the shortcomings of prior art curtain rod brackets B and the advancement provided by applicant's device by obviating cracks or striations C.

Referring now to FIGS. 2–7, a preferred embodiment of applicant's curtain rod mounting device is shown and generally designated 10. Curtain rod mounting device 10 is preferably formed from sheet metal steel (although other materials are contemplated by applicant including, but not limited to, aluminum, plastic and composite materials) and comprises front mounting surface 12, and top surface 14 and side surface 16 which depend rearwardly from front mounting surface 12 such that all three surfaces are in generally orthogonal relationship. Top surface 14 depending rearwardly from front mounting surface 12 includes wall securement flange 18 which extends upwardly from the rear edge of top surface 14. Thus, wall securement flange 18 is spaced-apart and generally parallel to front mounting surface 12, and most suitably includes two apertures 18A therein for receiving screws or nails so as to secure mounting device 10 to the window wall in a manner which will be described in more detail hereinbelow. Mounting device 10 also includes apertures 12A and 12B in front mounting surface 12 to provide for securing a conventional curtain rod bracket B (see particularly FIG. 4) thereto by means of a pair of conventional screws S and internally threaded nuts S'. The securement of curtain rod bracket B to mounting device 10 can best be seen in FIG. 3.

Figure 5:
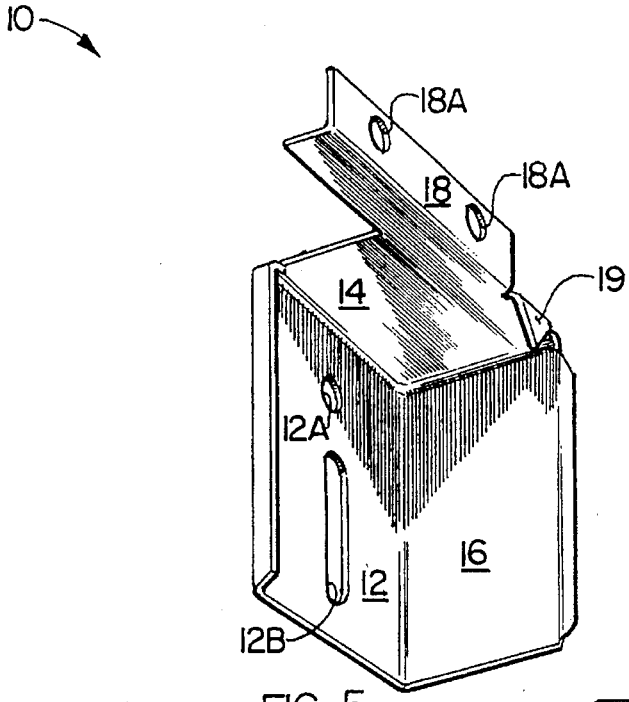
FIG. 5 is a back perspective view of the curtain rod mounting device of the invention.
Figure 7:
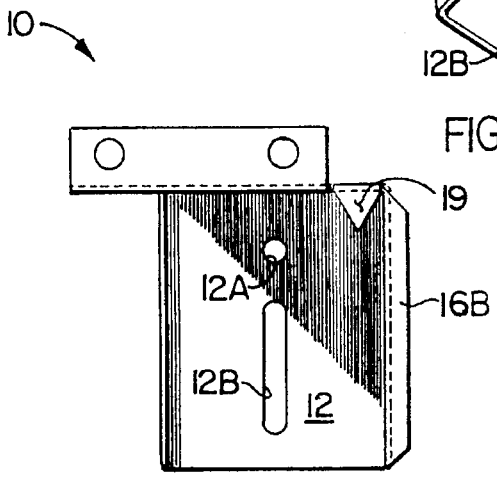
FIG. 7 is a back elevation view of the curtain rod mounting device of the invention.
Figure 6:
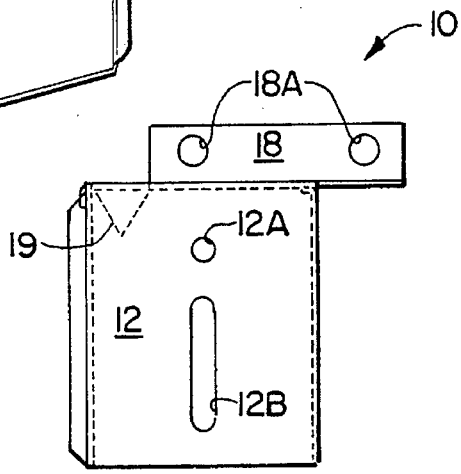
FIG. 6 is a front elevation view of the curtain rod mounting device of the invention.

With particular reference now to FIGS. 5 and 7, applicant will describe an optional feature of applicant's invention which renders it particularly easy to use. As can be seen in the aforementioned drawings, a molding engagement spike 19 depends downwardly from a portion of the rear edge of top surface 14 of mounting device 10. Molding engagement spike 19 allows a user of mounting device 10 to preliminarily secure the device to a window molding by placing mounting device 10 into loose contact with the corner of window molding WM and then applying firm pressure to top surface 14 so as to force molding engagement spike 19 downwardly into a position behind window molding WM so as to retain mounting device 10 in place when the user's hands are removed. Thereafter, screws or nails may be inserted through apertures 18A in wall securement flange 18 to permanently secure mounting device 10 into place for the subsequent securement of a curtain rod thereto. Thus, molding engagement spike 19 provides a substantially hands-free securement capability to mounting device 10 during attachment to the corner of window molding WM. This is very advantageous relative to the securement of conventional window rod bracket B to the corner of window molding WM (see FIG. 1).

In use, curtain rod bracket B (see particularly FIG. 3) would initially be secured by means of screws S and internally threaded nuts S' to front mounting surface 12 of mounting device 10. Next, mounting device 10 will be positioned on and preliminarily secured to the corner of window molding WM by means of molding engagement spike 19 as described hereinabove. Then, a pair of screws or nails are inserted through apertures 18A of wall securement flange 18 and through the sheetrock into the header of the window frame therebeneath so as to permanently secure mounting device 10 to window molding WM. Finally, after a pair of mounting devices 10 are mounted to opposing upper corners of window molding WM around a window (not shown), a curtain rod is secured to the curtain rod brackets B carried by mounting devices 10.

Figure 8:
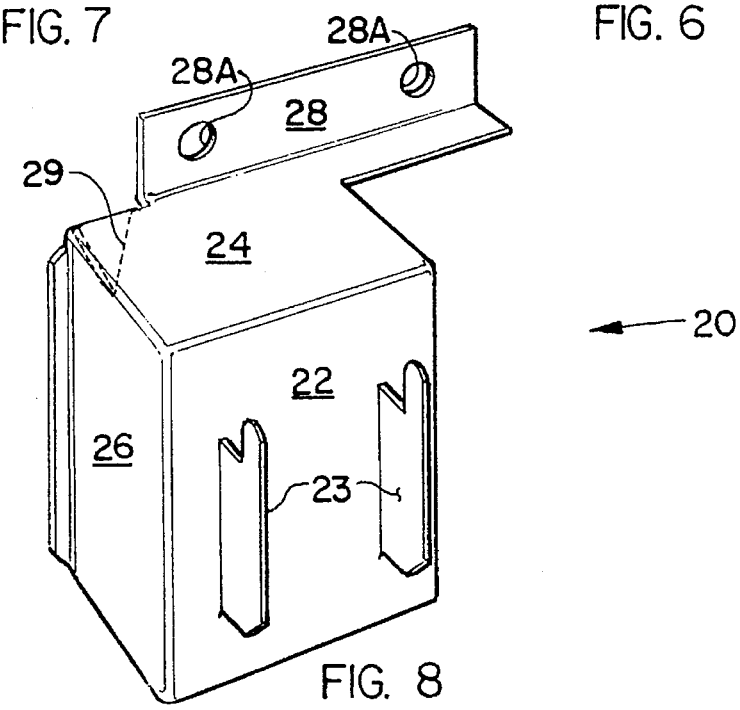
FIG. 8 is a front perspective view of an alternative embodiment of the curtain rod mounting device of the invention which incorporates an integral curtain rod bracket on the front surface thereof.

An alternative embodiment of applicant's invention is shown in FIG. 8 and generally designated 20. As in the first embodiment described in detail above, mounting device 20 comprises front mounting surface 22, top surface 24 and side surface 26 which are all in generally orthogonal relationship. Wall securement flange 28 with apertures 28A provided therein extends upwardly from at least a portion of the rear edge of top surface 24, and (optionally) molding engagement spike 29 depends downwardly from a portion of the rear edge of top surface 24. However, in lieu of apertures 12A and 12B provided in the front mounting surface of mounting device 10, mounting device 20 is formed with curtain rod bracket 23 suitably formed as an integral part of front mounting surface 22. Thus, mounting device 20 does not require that conventional curtain rod mounting bracket B be initially secured to each mounting device 20 prior to installment of mounting device 20 on each corner of window molding WM surrounding a window (not shown) to which a curtain rod is to be secured.

It will be understood that various details of the invention may be changed without departing from the scope of the invention. Furthermore, the foregoing description is for the purpose of illustration only, and not for the purpose of limitation—the invention being defined by the claims.

What is claimed is:

1. A device for mounting a curtain rod to a window without damaging the window molding comprising:

(a) a mounting housing comprising a front mounting surface having a top surface and a side surface depending rearwardly from two adjacent edges thereof, said front mounting surface and said top and side surfaces being in generally orthogonal relationship;

(b) said top surface which depends rearwardly from said front mounting surface including a wall securement flange adjacent to and extending upwardly from at least a portion of the rear edge thereof, wherein said wall securement flange is spaced apart and generally parallel to said front mounting surface and defines at least one aperture therein for receiving a wall securement element therein; and (c) said front mounting surface including means for removably securing one end of a curtain rod thereto.

2. The curtain rod mounting device according to claim 1 wherein said top surface of said mounting housing which depends rearwardly from said mounting surface further includes a molding engagement spike depending downwardly from a portion of the rear edge thereof, wherein said molding engagement spike is spaced apart and generally parallel to said front mounting surface.

3. The curtain rod mounting device according to claim 1 wherein said wall securement flange defines two apertures therein.

4. The curtain rod mounting device according to claim 1 wherein said means for removably securing one end of a curtain rod thereto comprises at least one aperture defined within said front mounting surface.

5. The curtain rod mounting device according to claim 4 wherein said at least one aperture comprises two spaced apart apertures and one of said two apertures defines an elongated slot.

6. The curtain rod mounting device according to claim 1 wherein said means for removably securing one end of a curtain rod thereto comprises a curtain rod bracket formed as an integral part of said front mounting surface.

7. The device according to claim 1 wherein said device is formed from a unitary sheet of metal.

8. A device for mounting a curtain rod to a window without damaging the window molding comprising:

(a) a mounting housing comprising a front mounting surface having a top surface and a side surface depending rearwardly from two adjacent edges thereof, said front mounting surface and said top and side surfaces being in generally orthogonal relationship;

(b) said top surface which depends rearwardly from said front mounting surface including a wall securement flange adjacent to and extending upwardly from at least a portion of the outermost edge thereof, wherein said wall securement flange is spaced apart and generally parallel to said front mounting surface and defines at least one aperture therein for receiving a wall securement element therein; and (c) said front mounting surface including at least one aperture therein for securing a curtain rod bracket thereto.

9. The curtain rod mounting device according to claim 8 wherein said top surface of said mounting housing which depends rearwardly from said mounting surface further includes a molding engagement spike depending downwardly from a portion of the outermost edge thereof, wherein said molding engagement spike is spaced apart and generally parallel to said front mounting surface.

10. The curtain rod mounting device according to claim 8 wherein said wall securement flange defines two apertures therein.

11. The curtain rod mounting device according to claim 10 wherein said front mounting surface includes two spaced apart apertures and one of said two apertures defines an elongated slot.

12. The device according to claim 8 wherein said device is formed from a unitary sheet of metal.

13. A device for mounting a curtain rod to a window without damaging the window molding comprising:

(a) a mounting housing comprising a front mounting surface having a top surface and a side surface depending rearwardly from two adjacent edges thereof, said front mounting surface and said top and side surfaces being in generally orthogonal relationship;

(b) said top surface which depends rearwardly from said front mounting surface including a wall securement flange adjacent to and extending upwardly from at least a portion of the rear edge thereof, wherein said wall securement flange is spaced apart and generally parallel to said front mounting surface and defines at least one aperture therein for receiving a wall securement element therein; and (c) said front mounting surface comprises a curtain rod bracket formed as an integral part thereof.

14. The curtain rod mounting device according to claim 13 wherein said top surface of said mounting housing which depends rearwardly from said mounting surface further includes a molding engagement spike depending downwardly from a portion of the outermost edge thereof, wherein said molding engagement spike is spaced apart and generally parallel to said front mounting surface.

15. The curtain rod mounting device according to claim 13 wherein said wall securement flange defines two apertures therein.

16. The device according to claim 13 wherein said device is formed from a unitary sheet of metal.

* * * * *